US007303802B1

(12) United States Patent
Brower et al.

(10) Patent No.: US 7,303,802 B1
(45) **Date of Patent: *Dec. 4, 2007**

(54) WALL PATCH

(75) Inventors: Jerry Brower, 6401 NW. Lincoln Ave., Vancouver, WA (US) 98663; Randall Eric Swanson, Camas, WA (US)

(73) Assignee: Jerry Brower, Vancouver, WA (US)

( * ) Notice: Subject to any disclaimer, the term of this patent is extended or adjusted under 35 U.S.C. 154(b) by 341 days.

This patent is subject to a terminal disclaimer.

(21) Appl. No.: 10/728,647

(22) Filed: Dec. 5, 2003

Related U.S. Application Data

(60) Continuation-in-part of application No. 10/618,166, filed on Jul. 10, 2003, which is a division of application No. 09/595,635, filed on Jun. 16, 2000, now Pat. No. 6,607,621.

(60) Provisional application No. 60/170,477, filed on Dec. 13, 1999.

(51) Int. Cl.
*B32B 35/00* (2006.01)
*B32B 7/12* (2006.01)

(52) U.S. Cl. ..... 428/63; 428/99; 428/343; 428/354; 156/71; 156/94; 156/98; 29/402.09; 29/402.11; 52/514

(58) Field of Classification Search ..... 428/63, 428/99, 343, 354; 156/71, 94, 98; 29/402.09, 29/402.11; 52/514
See application file for complete search history.

(56) References Cited

U.S. PATENT DOCUMENTS 1,044,323 A 11/1912 Wiggin
3,215,243 A 11/1965 Dickerson
4,008,115 A 2/1977 Fairbanks et al.
4,057,898 A 11/1977 Piosky
4,122,222 A * 10/1978 Parker ..... 428/64.1
4,135,017 A 1/1979 Hoffman, Sr.
4,358,495 A 11/1982 Parker (Continued)

OTHER PUBLICATIONS

Fasson Smudgeproof Kimdura S4600/78#BK, Specification #74259, Mar. 3, 2000, Fasson roll North America, Painesville, Ohio.

(Continued)

*Primary Examiner*—Daniel Zirker
(74) *Attorney, Agent, or Firm*—Marger Johnson & McCollom, P.C.

(57) ABSTRACT

A wall patch includes a substantially planar body, an adhesive located on a first surface of the body, a ready-to-paint second surface of the body, and an aperture in the body. The aperture is preferably sized to minimize a wall hole, such as is commonly made for installation of an electrical outlet or other household wall element. A method for repairing a wall hole includes identifying a wall hole to be repaired by covering less than a total hole area defined by the wall hole, said wall hole having a wall element mounted therein; applying over the wall hole a wall patch having a substantially planar body, an adhesive located on a lower surface of the body, a ready-to-paint upper surface of the body, and an aperture in the body having an aperture area less than the wall hole area; wherein the aperture of the wall patch partially covers the wall hole without obstructing access to the wall element; and painting directly over the wall patch.

17 Claims, 4 Drawing Sheets

*FIG. 6*

U.S. PATENT DOCUMENTS

| | | | |
|---|---|---|---|
| 4,460,420 | A | 7/1984 | Estrada |
| 4,584,218 | A | 4/1986 | Travis |
| 5,075,149 | A | 12/1991 | Owens et al. |
| 5,321,206 | A | 6/1994 | Hibler |
| 5,820,958 | A | 10/1998 | Swallow |
| 5,925,204 | A | 7/1999 | Hoffman, Sr. |
| 5,960,603 | A | 10/1999 | Redden et al. |
| 6,231,949 | B1 | 5/2001 | Hoffmann, Sr. |
| 6,607,621 | B1 * | 8/2003 | Swanson ..... 156/94 |

OTHER PUBLICATIONS

National Home Center News web site http://www.homecenternews.com/advertisers/walltool/wallrepair.html-Apr. 11, 2000.

CGC, Inc. web site http://www.cgcinc.com/cgcdiy/DIYPRODS/-Dec. 4, 1998.

United States Gypsum web site-2000 http://www.usg.com/pressroom/gyprels-Apr. 11, 2000.

* cited by examiner

WALL PATCH

This application is a continuation-in-part of U.S. Ser. No. 10/618,166 filed on Jul. 10, 2003, which is a divisional of U.S. Ser. No. 09/595,635, now U.S. Pat. No. 6,607,621 B1, filed on Jun. 16, 2000, which claimed priority from U.S. Provisional Application Ser. No. 60/170,477 filed on Dec. 13, 1999, which applications are incorporated herein by reference for all purposes.

BACKGROUND OF THE INVENTION

This invention relates generally to wall patches and methods for repairing holes in sheetrock, wallboard, or other wall surfaces, and more specifically to a wall patch for repairing a wall hole in which a wall element can be installed.

The sheetrock repair industry has been unable to provide a reliable wall repair system and method that are simple, fast, and strong. Traditional wall repair systems, for example, include a myriad of supplies and equipment that must be used to repair even small wall holes. Specifically, a typical drywall repair kit includes a curable, setting-type repair compound (or "mud"), drywall tape, sandpaper, a compound spreader, a cutting tool, a mixing tray, a mixing stick, sheetrock replacement panels, and more. Nearly all of these tools and supplies are required to complete even a relatively minor repair job.

Traditional wall repair methods that use these systems are difficult and time-consuming. This is because the traditional approach to repairing holes in sheetrock walls requires a series of fairly complex steps. Specifically, the traditional approach for a small hole begins by mixing the repair compound. A porous wall patch or strips of drywall tape adapted to receive the repair compound are then placed over the hole. The curable repair compound is then applied to the damaged wall area over the porous wall patch or drywall tape. Once the repair compound is applied, it must be allowed to cure. Unfortunately, even fast-curing repair compounds take approximately between 60-90 minutes to cure. Other repair compounds may take a day or more to cure. After the compound cures, the repaired area must be sanded flush with the rest of the wall. Following sanding, a texture coat must be applied to the repaired area to match the texture of the surrounding wall area. Finally, once the texture coat has dried, the repaired area is painted to match the color of the surrounding wall area.

If the hole is fairly large, the repair method is even more complex. Specifically, to repair a large hole, an area of sheetrock encompassing the hole must generally be cut out of the wall and a replacement piece of sheetrock must be cut to match the exact size of the removed area. The replacement sheetrock is placed within the cutout area and drywall tape is placed around the edges of the cutout. Mud is placed over the tape, allowed to cure, and then sanded. The entire patch area must then be textured and painted to match the surrounding wall surface.

In addition to the complexity, time, and number of materials required by the prior art repair methods, the repair areas of the prior art are often conspicuous following the repair. Generally, prior art repair areas protrude noticeably from the surface of the surrounding wall. It may also be fairly difficult to match the texture of the repaired area with that of the surrounding wall surface.

Moreover, it frequently happens that an individual installing a wall element, e.g. an electrical outlet box, light switch box, cable jack module, cuts too large a hole in the wall for the element, such that the standard wall plate used to finish such elements will not cover the wall hole.

It is difficult at best to repair the wall hole with a patch plate—especially patch plates having a metal reinforcement—and re-cut the wall hole for the element to be installed.

What is needed, therefore, is a wall repair system that avoids the need for expensive tools and repair compounds that need to cure. The industry would also be benefited by a wall repair method that substantially reduces the number of steps, the expertise, and the amount of time required to repair a wall hole or crack. The industry would further be benefited by a repair system and method that more easily matches the surrounding wall textures and provides a less noticeable repair area around an overlarge wall hole for a wall element.

SUMMARY OF THE INVENTION

According to the needs of the industry, one object of the present invention is to enable a wall repair system that eliminates the need for expensive repair tools and curable repair compounds.

Another object of the present invention is to enable a wall repair system that provides an inconspicuous repair area.

Yet another object of the present invention is to enable a person to simply and reliably repair overlarge holes formed in sheetrock for a wall element.

This invention provides a significant improvement in the art by enabling a self-adhesive wall patch that can be painted directly without the need for curing compounds, sanding, or other treatment. A wall patch according to the invention includes a substantially planar body having an inward surface and an outward surface and an aperture. The body can be circular, rectangular, arranged in a strip, or configured in any other desirable shape. A preferred shape for many applications is circular or oval. The body is preferably formed from a tough, stretch and tear resistant material. The inward surface of the body comprises or accepts an adhesive to adhere to the wall surface. The outward surface of the patch is directly paintable. The outward surface may further comprise a textured surface to match the surrounding wall area.

The aperture can be sized to partially cover a wall hole, providing access to the wall element after wall patch installation while covering the excess area of the wall hole.

In one embodiment, the wall patch is made of thin, flexible material such as a thin plastic film, a fibered paper, or other similar material. The material can be tough and both tear- and stretch-resistant. The wall patch of this embodiment can be applied directly over a hole in a wall. It can then be painted to match the surrounding wall area.

According to another embodiment, the wall patch is formed of a thicker, more rigid material such as sheet metal or thermoset plastic, for example. When this rigid wall patch is used, an upper surface of the wall area surrounding the hole is removed in the shape of the wall patch to form a recessed area. The depth of the recessed area should be approximately equal to the thickness of the wall patch. The wall patch is inserted into the recessed area and can then be painted directly. It can also be provided with a pre-textured upper surface. Alternatively, this rigid wall patch can be provided without a surface that is pre-textured and adapted to be paintable and can act as a center reinforcement for the wall patch of the first embodiment. In this case, the thicker wall patch is installed as described previously, but is then covered with the flexible, thin wall patch having a directly paintable, and possibly pre-textured, outward surface.

BRIEF DESCRIPTION OF THE DRAWINGS

The foregoing and other objects, features and advantages of the invention will become more readily apparent from the following detailed description of several embodiments of the invention which proceeds with reference to the accompanying drawings, in which.

DETAILED DESCRIPTION

Figure 1:
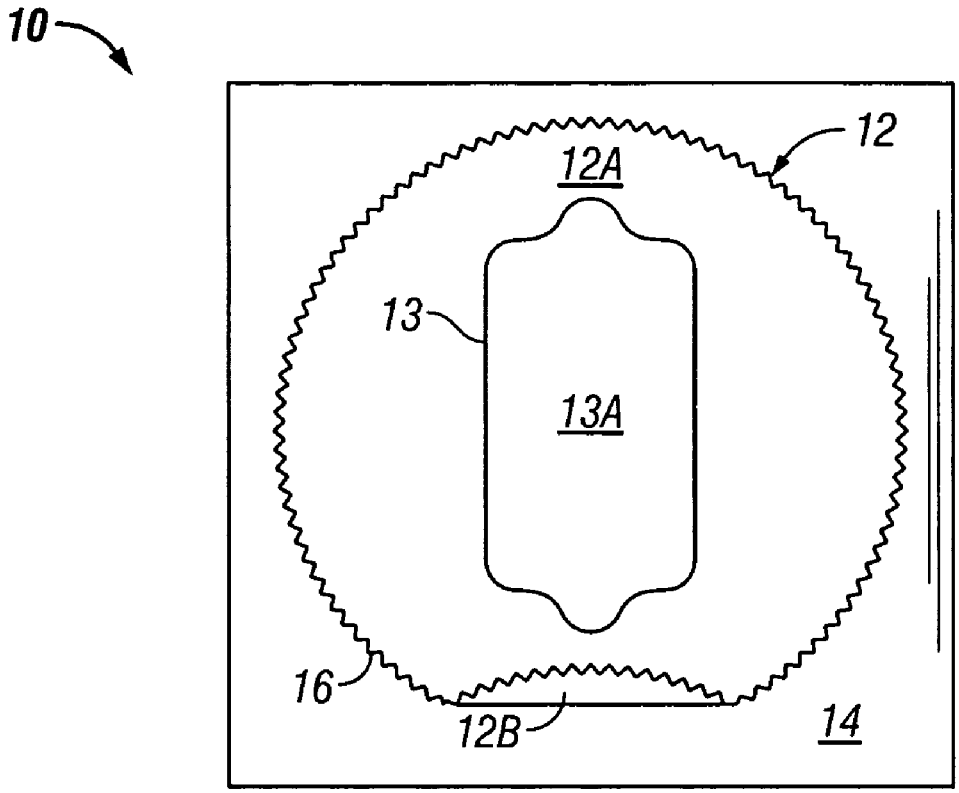
FIG. 1 is a top view diagram of a wall patch and adhesive backer according to a first embodiment of the present invention.
Figure 2:
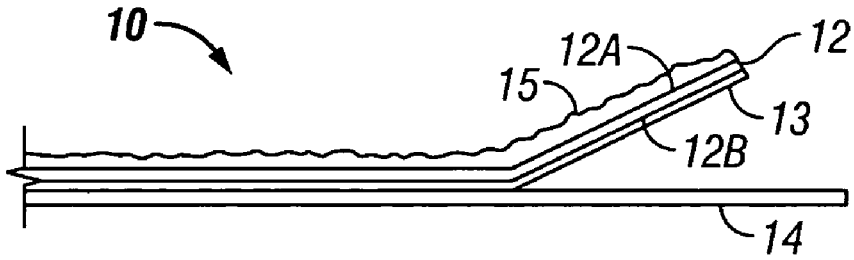
FIG. 2 is a side view diagram of the embodiment of FIG. 1.

Referring to FIGS. 1 and 2, a wall patch 10 according to a first embodiment of the invention has a thin, substantially planar body 12. The body 12 can be formed of any thin, plastic film, fibered-paper, or other similar material. Preferably, the material should be fairly strong (i.e., high tensile strength and low elasticity) and be resistant to both punctures and tears. The material should also preferably be able to retain nails or other wall fasteners in a way similar to the original wall structure. Presently, the most preferred material for the body 12 is Fasson® Smudgeproof Kimdura™/S4600/78#BK biaxially oriented three-ply polypropylene film, available from Avery Dennison. It should be noted, however, that other plastics or paper can be used. A polyester film, such as Dupont's Mylar® film, could be used, for example.

The body 12 of the wall patch 10 has two surfaces 12A, 12B. A first, upper surface 12A is directly paintable. A second, lower surface 12B is provided with an adhesive to enable the body 12 to be readily secured to a wall to be repaired. For convenience, an easily removable adhesive backing 14 is also provided, in physical communication with the adhesive on the second surface 12B, to prevent unwanted adhesion to other surfaces.

The upper surface 12A can also be pre-textured to provide a surface texture that matches the surrounding wall textures. Pre-texturing can be done by applying a texture coat layer 15, formed from texture material commonly used in texturing sheetrock, onto the upper surface 12A of the body 12. Although traditional texture sprays consist of only mud and water, a preferred texture material according to this invention includes paint, as well as mud and water, in order to provide a durable, yet flexible texture coat layer 15 for the patch 10. The preferred formula for the texture material is one gallon of paint to five gallons of mud and one quart of water. The texture coat is applied to the upper surface 12A of the body 12 by spray coating.

A wall patch 10 having a smooth upper surface 12A can also be provided for use in repairing walls that have a non-textured wall surface. Preferably, a package of wall patches or wall repair kit presented for commercial sale includes patches 10 having several different textures to allow selection of the texture that best matches the surrounding wall area. Typical textures may include light, medium, and heavy.

The body 12 of the wall patch 10 further comprises an inner edge 13 defining an aperture 13A, which preferably is substantially centered in the body 12. The aperture 13A can be sized to permit access therethrough to a variety of wall elements, such as an electrical outlet module, light switch module, cable or networking connection, telephone jack module, thermostat module, or other module commonly installed in a wall of a home, office, or other structure.

As can be seen from FIG. 1, the wall patch according to the first embodiment also preferably includes a "pinked" or "feathered" edge 16 around the perimeter of the wall patch. Feathered edges 16 are desirable when repairing holes in a wall, especially when the wall has a textured surface, because the feathering enables the wall patch to mate more easily with and blend into the surrounding wall surface. Specifically, for textured wall surfaces, the feathered edge 16 allows the serrations along the edge of the wall patch to slip in between protrusions of the surrounding wall texture and the resulting repaired area is therefore less conspicuous. Even for smooth wall surfaces, however, the feathered edge breaks up the outline of the wall patch and makes it more difficult to discern the repaired area.

Other features of this embodiment also make areas repaired with it less conspicuous. For instance, the wall patch 10 of this embodiment is thin and does not require the application of a curable repair compound in use. Accordingly, the wall patch 10 forms a tough diaphragm over the hole that is thin enough that the repaired area is substantially flush with the surrounding wall area. It is therefore more difficult to identify the repaired area after the wall repair is completed than with conventional repaired areas that tend to protrude noticeably from the surrounding wall surface.

A rigid wall patch preferably includes one or more projections for securing the wall patch to the sheetrock. In this preferred embodiment, the wall patch is a thin, flat, sheet metal plate having a substantially rectangular shape with each of the four corners thereof bent inwardly to provide the projections for securing the wall patch to the wall. It should be noted, however, that the wall patch can be made of injection molded, thermoset, or other plastic or other suitable materials and can also be configured in any desired shape or size. The wall patch, for example, could be made circular or oval.

Furthermore, the projections can be formed thereon in any desired manner. Also, although self-securing projections are desirable to simplify use of the wall patch, they are not essential. Nails, tacks, adhesive, as well as any other appropriate type of mechanical or chemical fastener can be used to secure the wall patch to the wall instead of projections.

Figure 3:
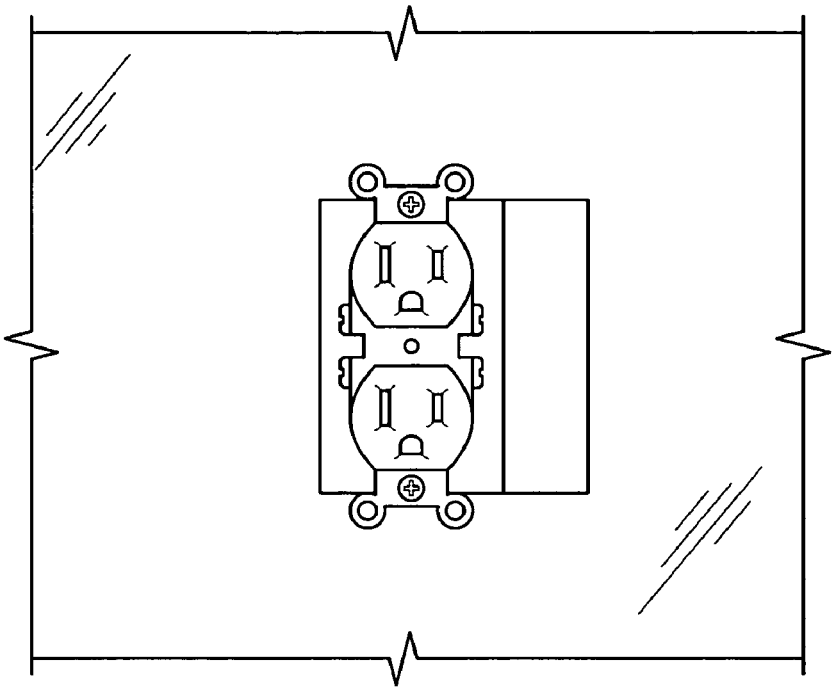
FIG. 3 (Prior Art)
FIG. 3 is a diagram of a wall outlet installed in an improperly sized wall hole.
Figure 4:
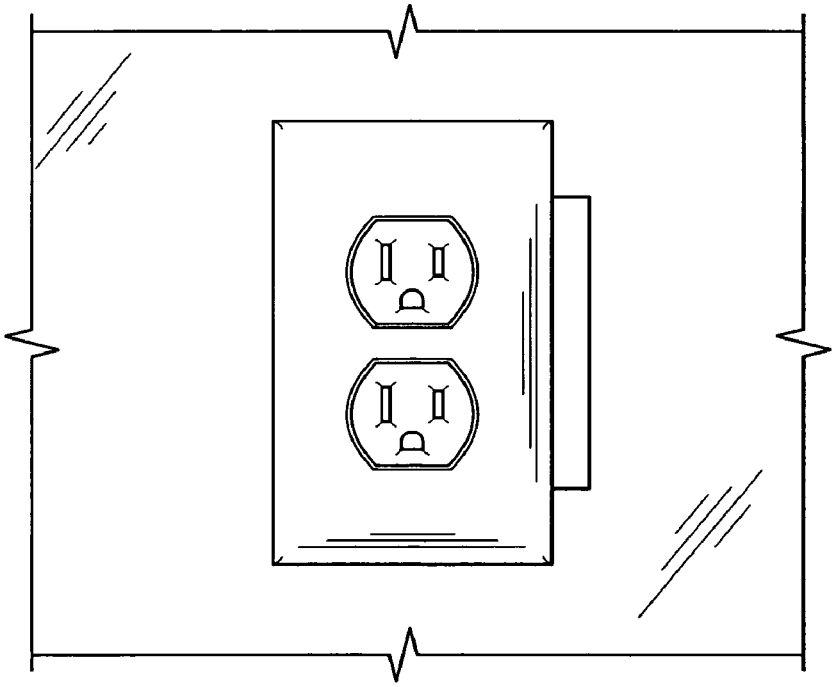
FIG. 4 (Prior Art)
FIG. 4 is a diagram of the wall outlet of FIG. 3, with a conventional electrical outlet plate installed thereover.

Referring now to FIGS. 3-4, a standard electrical outlet is installed in a wall. As shown, the outlet has been improperly installed in an off-center orientation. Such improper installations can occur when a hole for the wall component is cut too large or too far from a wall anchoring point (e.g., a wall stud).

When the electrical outlet and outlet box are installed in the wall, it is apparent that the outlet is off-center in the wall hole. Installation of a conventional outlet plate over the mis-installed outlet results in a portion of the hole being visible outside the periphery of the outlet plate. The outlet plate installation of FIG. 4 is unsightly and dangerous, as it renders the wall hole and wires therein partially accessible.

A repair of an improperly installed outlet using the present wall patch is shown in FIGS. 5A-8. A method of repairing a hole 42 in a wall 44 according to this embodiment begins by selecting a wall patch 10 of an appropriate size. Various sizes can be provided, with a preferred range of sizes being from approximately 0.1 inches (2.5 mm) to 6.0 inches (15 cm).

Figure 5A:
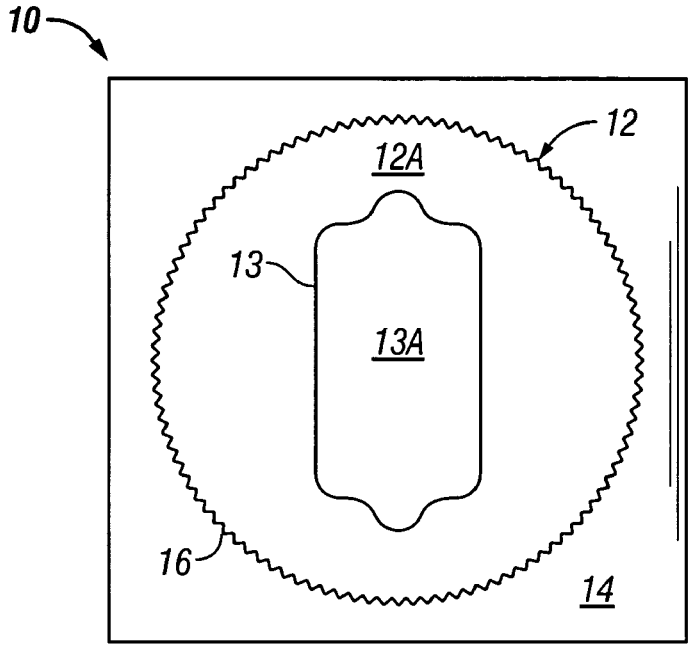
FIG. 5A is a top plan view of the wall patch of FIG. 1, according to yet another aspect of the invention.
Figure 5B:
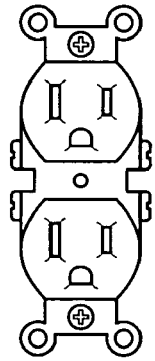
FIG. 5B is a diagram of a conventional wall electrical outlet.
Figure 6:
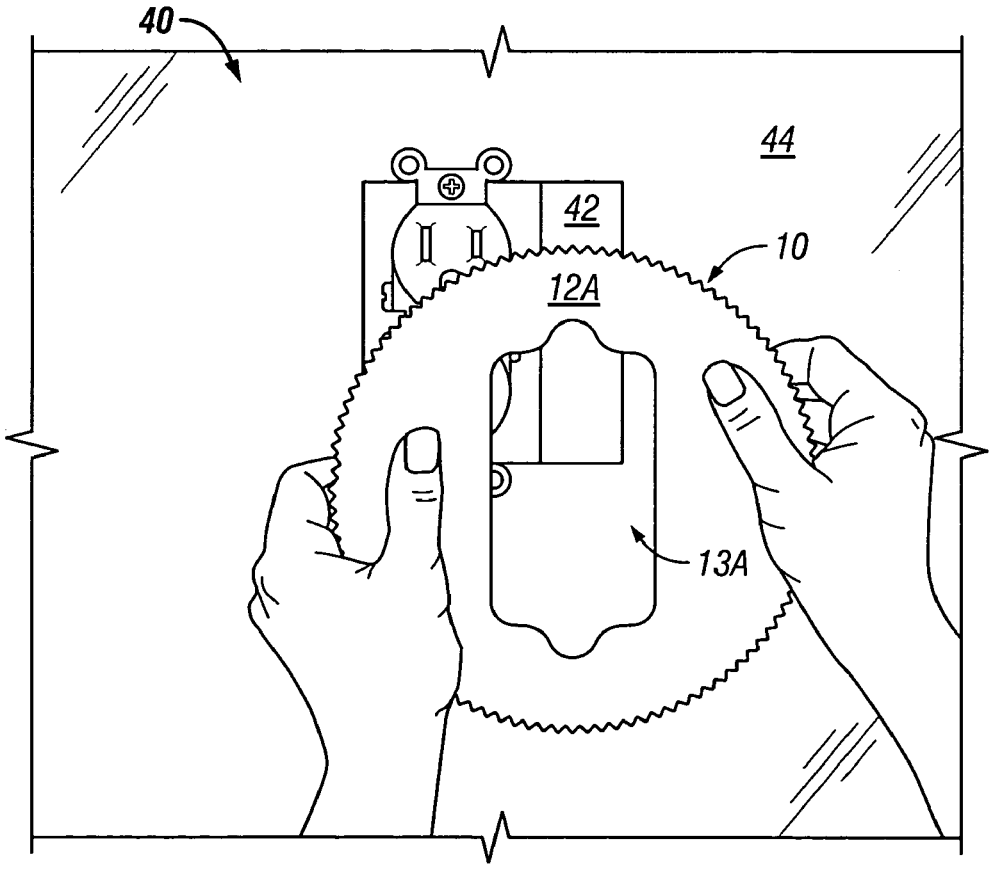
FIG. 6 is a diagram of a wall patch of the present disclosure being applied to the improperly installed outlet of FIG. 3.

Furthermore, it can be beneficial to select a particular aperture size and/or shape, based on the hole to be repaired and the wall element to reside in the wall hole. A suitable wall patch 10 is shown in FIG. 5A. The aperture 13A is sized and shaped to conform to the dimensions of the standard electrical outlet (FIG. 5B). Providing various size patches and apertures allows the repair of many different size holes, ranging, for example, from telephone or cable jacks to a dual light switch box.

The wall surface 44 surrounding the hole 42 preferably is clean, ensuring good adhesion with the wall patch 10. Any rough or uneven edges protruding from the damaged wall area above the plane of the wall surface 44 preferably are removed to allow the wall patch 10 to lie flush with the wall surface 44.

The adhesive backing 14 is removed from the wall patch 10 and the patch 10 is then positioned over the hole 42, such that the aperture is properly positioned over the wall hole and any wall element installed therein, and secured to the wall surface 44. Any air trapped under the margins of the wall patch 10 preferably is pressed out from the edges 16 of the patch 10 without placing any force on the center portion of the patch 10.

Figure 7:
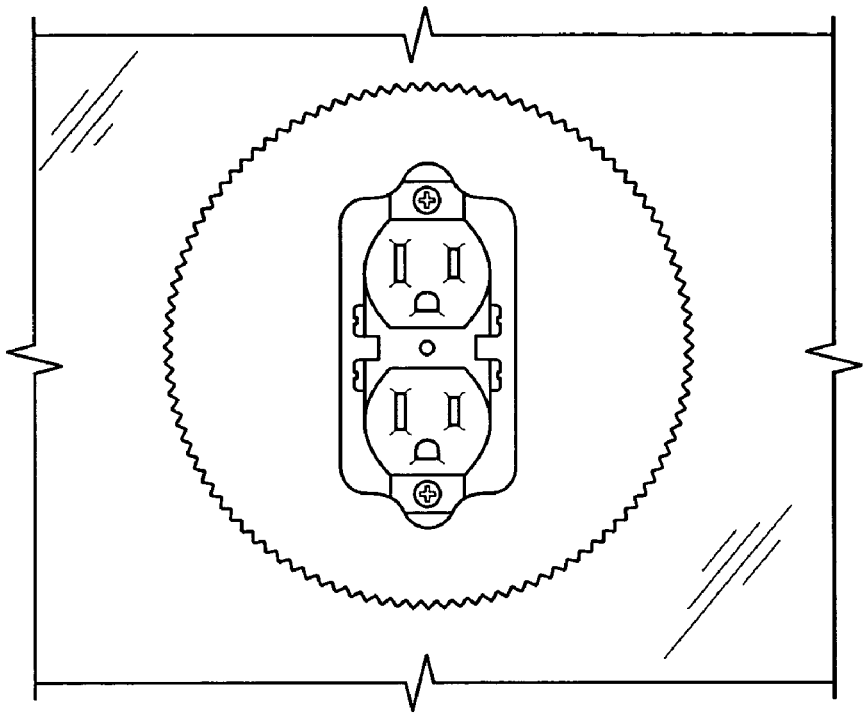
FIG. 7 is a diagram of the wall patch of FIG. 1 installed over the outlet of FIG. 3.
Figure 8:
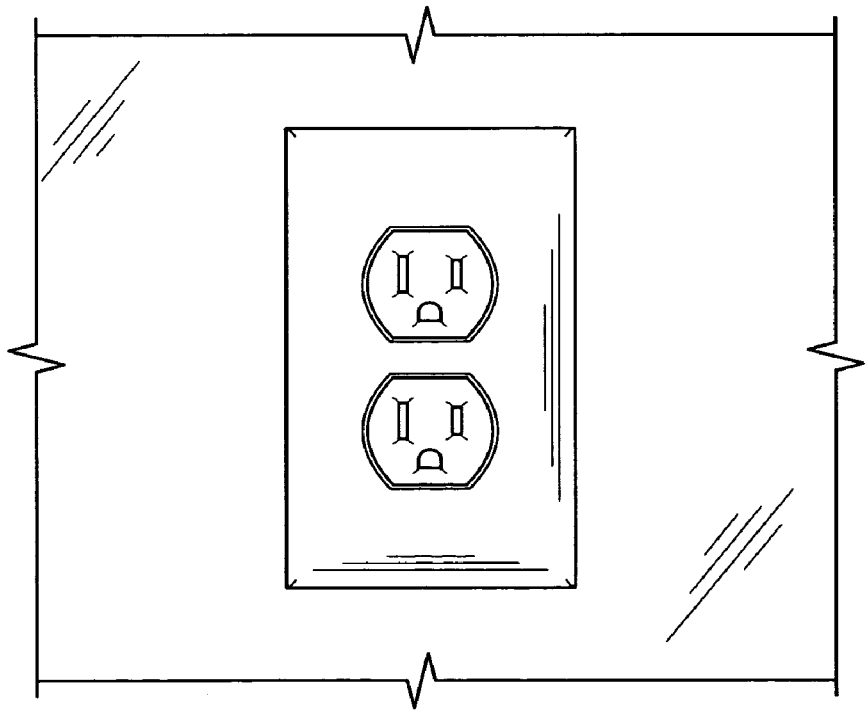
FIG. 8 is a diagram of the wall outlet and wall patch of FIG. 7, with a conventional electrical outlet plate installed thereover.

The wall patch 10 is centered over the electrical outlet and hides the asymmetric wall hole (FIG. 7). Installation of a wall outlet plate can be conventionally carried out, resulting in a repaired area that conceals the incorrect wall hole, prevents inadvertent access to the outlet box and wires, and blends well with the surrounding wall area.

Once the wall patch 10 has been affixed to the wall, it can immediately be painted, and does not require the application of a curable repair compound, sanding, or any other special pre-painting treatment. Furthermore, with a pre-textured wall patch 10, there is no need to apply a texture coating to the repaired area. Accordingly, the only equipment needed for repairing a wall according to this method of the invention is a wall patch 10 and a user's hands.

Because of these features, the wall repair method of this invention provides substantial advantages over the prior art in terms of repair time, and in terms of the number of materials and tools required to perform the repair. These additional benefits make this wall patch system and method fast, convenient, and easy. Furthermore, the wall patch 10 according to this invention is strong enough to provide a durable and reliable wall repair. A still further benefit of this invention is that the resulting repair is inconspicuous.

Aperture reinforcements can also be made from a non-textured flexible material, such as a plastic film or fibered paper, having an adhesive attachment surface, similar to the wall patch 10 of the first embodiment. A preferred aperture reinforcement material is fibered paper, coated with a plastic laminate, such as is conventionally used for decals.

Having described and illustrated the principles of the invention in a preferred embodiment thereof, it should be apparent that the invention can be modified in arrangement and detail without departing from such principles. I claim all modifications and variations coming within the spirit and scope of the following claims.

What is claimed is:

1. A wall patch, comprising:
a substantially planar body;
a perimeter having a feathered edge;
an adhesive located on a first surface of the body; and
a ready-to-paint second surface of the body.

2. The wall patch of claim 1 wherein the body comprises a sheet of material having a substantially uniform thickness.

3. The wall patch of claim 1 wherein the ready-to-paint second surface comprises a textured surface.

4. The wall patch of claim 1 wherein the body is formed from a tear-resistant material.

5. The wall patch of claim 1, further comprising an aperture formed through the wall patch.

6. The wall patch of claim 5, wherein the aperture is sized to surround a wall-mounted object.

7. The wall patch of claim 6 wherein the wall-mounted object is selected from the group consisting of an electrical outlet element, a switch element, a thermostat element, a telephone element, a cable television element, and a networking connection element.

8. The wall patch of claim 5, wherein the aperture has a boundary defining an open area less than a wall open area defined by a wall hole.

9. The wall patch of claim 5, further comprising:
an aperture reinforcement at least partially surrounding the aperture.

10. The wall repair system of claim 9 wherein the aperture reinforcement is constructed of rigid metal.

11. The wall repair system of claim 9 wherein the aperture reinforcement is constructed of plastic.

12. A wall patch, comprising:
a sheet having a substantially uniform thickness, and further comprising a lower surface and an upper surface;
a pre-textured, ready-to-paint layer applied to the upper surface; and
a perimeter of the sheet having a feathered edge.

13. The wall patch of claim 12, further comprising an aperture formed through the wall patch and configured to surround a wall element.

14. The wall patch of claim 13, wherein the wall element is selected from the group consisting of an electrical outlet element, a switch element, a thermostat element, a telephone element, a cable television element, and a networking connection element.

15. The wall patch of claim 13, further comprising a reinforcement member at least partially surrounding the aperture.

16. A wall patch, comprising:
a flexible material having a substantially uniform thickness and including an upper surface and a lower surface;
a perimeter having an uneven feathered edge;
an adhesive layer applied to the lower surface of the material; and
wherein the upper surface of the material is ready-to-paint.

17. The wall patch according to claim 16, further comprising an aperture formed through the wall patch.

* * * * *